US012188184B2

(12) United States Patent
Philipp

(10) Patent No.: US 12,188,184 B2
(45) Date of Patent: Jan. 7, 2025

(54) TAMPING ASSEMBLY FOR TAMPING SLEEPERS OF A TRACK

(71) Applicant: Plasser & Theurer Export von Bahnbaumaschinen GmbH, Vienna (AT)

(72) Inventor: Thomas Philipp, Leonding (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 927 days.

(21) Appl. No.: 17/278,820

(22) PCT Filed: Sep. 24, 2019

(86) PCT No.: PCT/EP2019/075584
§ 371 (c)(1),
(2) Date: Mar. 23, 2021

(87) PCT Pub. No.: WO2020/083590
PCT Pub. Date: Apr. 30, 2020

(65) Prior Publication Data

US 2022/0034043 A1 Feb. 3, 2022

(30) Foreign Application Priority Data

Oct. 24, 2018 (AT) ..... A 330/2018

(51) Int. Cl.
*E01B 27/16* (2006.01)

(52) U.S. Cl.
CPC ..... *E01B 27/16* (2013.01); *E01B 2203/12* (2013.01)

(58) Field of Classification Search
CPC ..... E01B 27/12; E01B 27/16; E01B 27/17; E01B 27/18; E01B 27/20; E01B 2203/12;
(Continued)

(56) References Cited

U.S. PATENT DOCUMENTS 3,589,297 A 6/1971 Plasser et al.
3,608,498 A 9/1971 Plasser et al.
(Continued)

FOREIGN PATENT DOCUMENTS

AT 343 168 B 5/1978
AT 521673 B1 4/2020
(Continued)

OTHER PUBLICATIONS

International Search Report of PCT/EP2019/075584, mailed Dec. 16, 2019.
(Continued)

*Primary Examiner* — Zachary L Kuhfuss
*Assistant Examiner* — Heaven R Buffington
(74) *Attorney, Agent, or Firm* — Collard & Roe, P.C.

(57) ABSTRACT

The invention relates to a tamping assembly for tamping sleepers of a track, including a tamping unit having oppositely positioned tamping tools mounted on a vertically adjustable tool carrier, the tamping tools being coupled in each case via a squeezing drive to a vibration drive, wherein each tamping tool comprises a pivot lever rotatable about a pivot axis and at least one tamping tool mount for accommodating at least one tamping tine. In this, a first squeezing drive is coupled directly to the vibration drive and articulatedly connected to a first pivot lever, and a second squeezing drive is coupled to the vibration drive via a separate coupling unit and articulatedly connected to a link, mounted on the tool carrier, as well as to a second pivot lever. In this manner, the tamping unit can be configured in a very compact way with squeezing drives being arranged one below the other, wherein forces and momentums occurring during operation can be easily controlled.

9 Claims, 2 Drawing Sheets

(58) Field of Classification Search
CPC ..... E01B 2203/122; E01B 2203/125; E01B 2203/127
USPC ..... 104/10, 12
See application file for complete search history.

(56) References Cited

U.S. PATENT DOCUMENTS

| | | | | |
|---|---|---|---|---|
| 4,069,763 | A | 1/1978 | Theurer | |
| 10,100,469 | B2 | 10/2018 | Lichtberger | |
| 10,208,432 | B2 * | 2/2019 | Seyrlehner | B06B 1/18 |

FOREIGN PATENT DOCUMENTS

| | | | | |
|---|---|---|---|---|
| JP | 2002-146702 | A | 5/2002 | |
| WO | 2016/100993 | A1 | 6/2016 | |
| WO | WO-2018149628 | A1 * | 8/2018 | B06B 1/16 |

OTHER PUBLICATIONS

Indian Examination Report in Indian Application No. 202127009362 dated Sep. 26, 2022 with English translation.

* cited by examiner

TAMPING ASSEMBLY FOR TAMPING SLEEPERS OF A TRACK

CROSS REFERENCE TO RELATED APPLICATIONS

This application is the National Stage of PCT/EP2019/075584 filed on Sep. 24, 2019, which claims priority under 35 U.S.C. § 119 of Austrian Application No. A 330/2018, filed on Oct. 24, 2018, the disclosure of which is incorporated by reference. The international application under PCT article 21 (2) was not published in English.

FIELD OF TECHNOLOGY

The invention relates to a tamping assembly for tamping sleepers of a track, including a tamping unit having oppositely positioned tamping tools mounted on a vertically adjustable tool carrier, the tamping tools being coupled in each case via a squeezing drive to a vibration drive, wherein each tamping tool comprises a pivot lever rotatable about a pivot axis and at least one tamping tool mount for accommodating at least one tamping tine.

PRIOR ART

For restoring or maintaining a prescribed track position, tracks having a ballast bed are regularly treated by means of a tam ping machine. During this, the tamping machine travels on the track and lifts the track grid formed of sleepers and rails to a target level by means of a lifting-/lining unit. A fixation of the new track position takes place by tamping the sleepers by means of a tamping assembly. The tamping assembly comprises tamping tools with tamping tines which—actuated with a vibration—penetrate into the ballast bed during a tamping operation and are squeezed towards one another. In doing so, the ballast underneath the respective sleeper is consolidated.

Tamping assemblies of this type for tamping sleepers of a track have long been known. AT 343 168 B, for example, discloses a tamping assembly having a tool carrier on which a vibration drive and two pivoted tamping tools are arranged. In this, each tamping tool includes a pivot arm which is connected via an associated squeezing drive to the vibration drive. The squeezing drives are aligned on opposite sides of the vibration drive approximately on a common axis. Thus, the overall length of the tamping assembly in the longitudinal direction of the rails is about double the length of a squeezing drive and so exceeds a standard sleeper distance. Therefore, such a design is not suited for an arrangement of several structurally identical tamping assemblies within one machine for simultaneously tamping adjoining sleepers.

A tamping assembly with reduced dimensions is disclosed in Austrian patent application A 325/2017. Here, squeezing drives arranged next to one another are supported on consoles which, in turn, are connected to a common vibration drive. This design is very compact; however, as a result of the squeezing drives being arranged beside one another, there are during operation momentums about a vertical axis. These momentums have to be absorbed by correspondingly sized components.

SUMMARY OF THE INVENTION

It is the object of the invention to show a design improved over the prior art for a tamping assembly of the type mentioned at the beginning.

According to the invention, this object is achieved by way of the features of claim 1. Dependent claims indicate advantageous embodiments of the invention.

In this, it is provided that a first squeezing drive is coupled directly to the vibration drive and articulatedly connected to a first pivot lever, that a second squeezing drive is coupled to the vibration drive via a separate coupling unit and articulatedly connected to a link, mounted on the tool carrier, as well as to a second pivot lever. In this manner, the tamping unit can be configured in a very compact way with the squeezing drives being arranged one below the other, wherein forces and momentums occurring during operation can be easily controlled. The dimensioning of the individual components does not lead to a weight increase as compared to conventional tamping assemblies with squeezing drives connected opposite one another directly to the vibration drive and pivot arms spread outwardly. In the arrangement according to the invention, there is no necessity for the spread-apart pivot arms, thus compensating the additional mass of the coupling unit.

An improvement of the kinematic relationships provides that the pivot axes of the two pivot levers are arranged at different heights. During operation, this measure causes balanced leverage forces at the two tamping tools, in that the lever relationships of the two pivot levers are matched to one another. In addition, equal lifting paths of the squeezing drives cause equal squeezing paths at the free ends of the tamping tools.

In an advantageous embodiment of the invention, the vibration drive includes an eccentric shaft, wherein an articulated lug of the first squeezing drive is mounted on a first eccentric shaft section, and wherein an articulated lug of the coupling unit is mounted on a second eccentric shaft section. In this, the vibration motions transmitted by the vibration drive to the articulated lugs are predefined exactly by eccentricities of the eccentric shaft, independently of counterforces. This advantage is omitted with other vibration generators which produce a vibration by means of imbalances or by pulsating actuation of a hydraulic cylinder.

In this, it is useful if the first eccentric shaft section and the second eccentric shaft section have different eccentricities. The respective eccentricity can be adapted to the kinematic arrangement of the vibration-transmitting components. Thus it is ensured that, at each tamping tine end, the same vibration amplitude with an approximately equal impact force acts on the ballast to be consolidated.

In a further improvement, each squeezing drive comprises a hydraulic cylinder having an effective axis, wherein all effective axes lie in a common plane of symmetry extending perpendicularly to the pivot axes. Thus it is ensured that all components for transmission of the squeezing forces are strained symmetrically and there are no interfering momentums.

In this, it is favourable if the coupling unit has two coupling arms which are arranged symmetrically to the plane of symmetry, and/or if the link has two link arms which are arranged symmetrically to the plane of symmetry. Then, essentially only tensile- and compressive forces act on the coupling unit or the link, which facilitates an optimized dimensioning of the two coupling arms or link arms.

For uniform transmission of the vibration forces to the second tamping tool, it is advantageous if a connection of the second squeezing drive to the coupling unit is designed as a swivel joint having a rotation axis extending parallel to the pivot axes. In this manner, the second squeezing drive forms the coupler of a double link with an optimal support of the forces prevailing in operation.

In this, it is favourable if the connection of the second squeezing drive to the coupling unit and to the link is designed as a common swivel joint. This reduces the number of components and the wear connected thereto.

Additionally, the kinematics of the arrangement are particularly advantageous if the link is mounted for rotation about the pivot axis of the first pivot lever. This measure also leads to a reduction of the number of components by using an already existing swivel joint. For example, merely an already provided rotating pin is designed to be longer for additional support of the link.

In an advantageous further development of the tamping assembly, several tool carriers are mounted for vertical adjustment in a common assembly frame. In this way, the compact design is utilized for creating a multi-sleeper tamping assembly, wherein several structurally identical tamping assemblies are arranged. The tamping units mounted one following the other in the common assembly frame can then be lowered into a ballast bed together in order to simultaneously tamp several sleepers lying adjacent to one another.

BRIEF DESCRIPTION OF THE DRAWINGS

The invention will be described below by way of example with reference to the accompanying drawings. There is shown in a schematic manner in.

DESCRIPTION OF THE EMBODIMENTS

Figure 2:
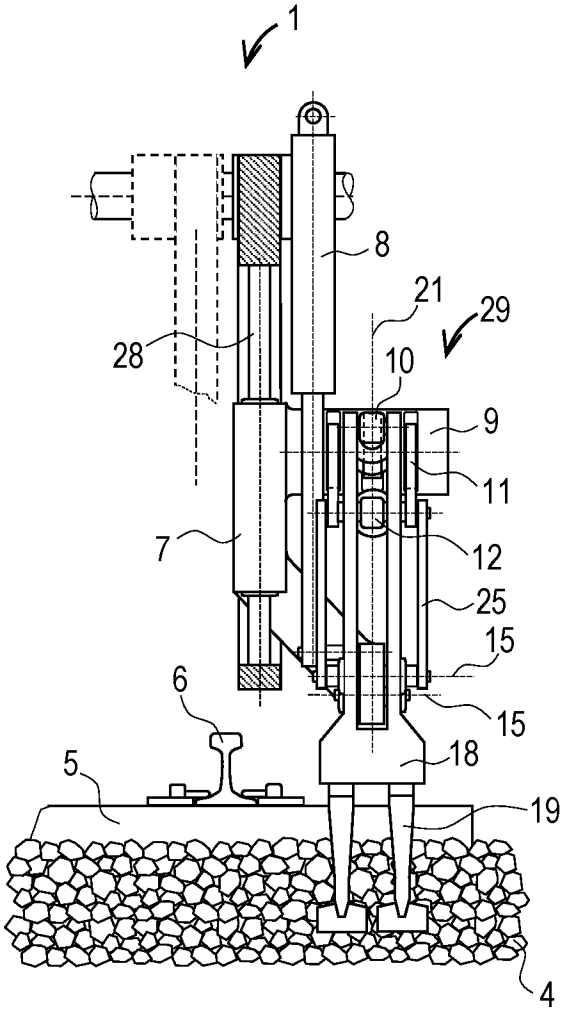
FIG. 2 a front view of the tamping assembly according to FIG. 1
Figure 1:
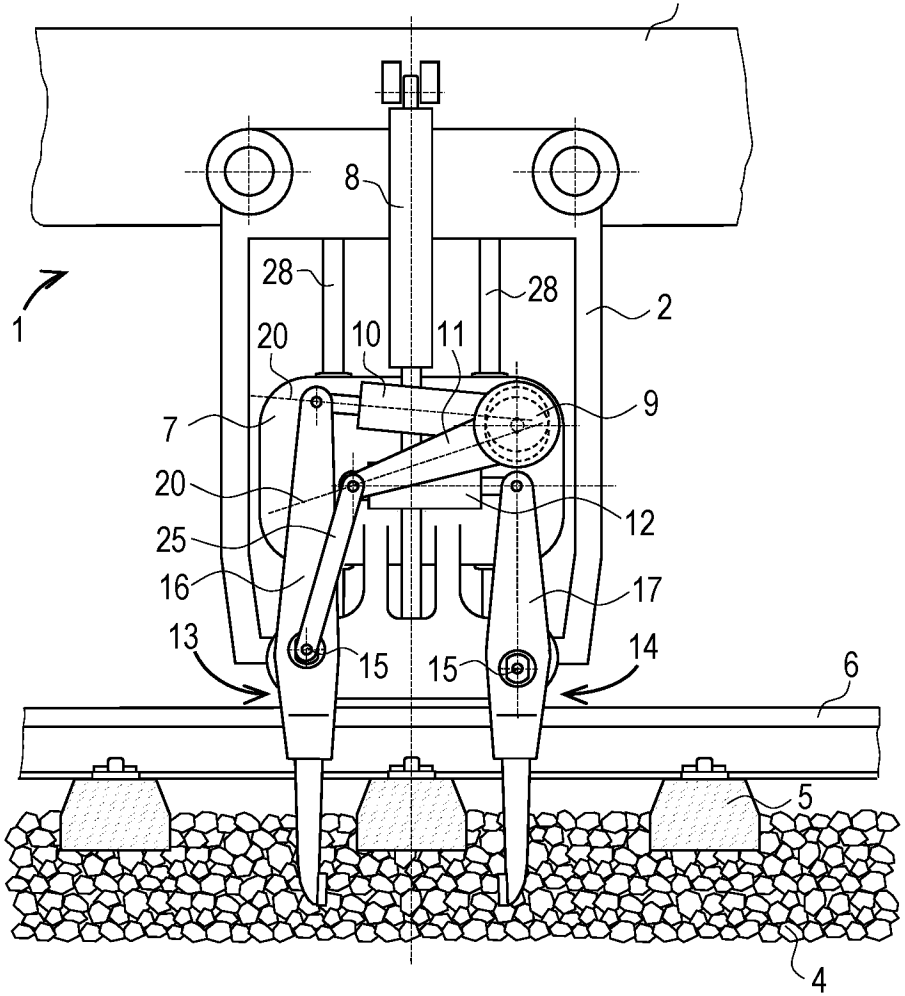
FIG. 1 a side view of a tamping assembly

The tamping assembly 1 shown in FIGS. 1 and 2 comprises an assembly frame 2 which is fastened to a machine frame 3 of a track maintenance machine not further shown. During working operations, the track maintenance machine travels on a track having sleepers 5 supported on a ballast bed 4 and rails 6 fastened on the former. During this, the sleepers 5 are tamped in sequence by means of the tamping assembly 1.

A tool carrier 7 is guided for vertical adjustment in the assembly frame 2, wherein a lowering- or lifting motion takes place by means of an associated vertical adjustment drive 8. Arranged on the tool carrier 7 is a vibration drive 9 to which at least one first squeezing drive 10 and a separate coupling unit 11 for a second squeezing drive 12 are connected. Mounted additionally on the tool carrier 7 are at least a first tamping tool 13 and a second tamping tool 14 which are rotatable about a respective pivot axis 15. In this, each tamping tool 13, 14 comprises a pivot lever 16, 17 and a tamping tool mount 18 for accommodating at least one tamping tine 19.

Used as a vibration drive 9, for example, is an eccentric drive having a rotating eccentric shaft, wherein, for each tamping tool 13, 14, an associated eccentricity $e_1$, $e_2$ predefines a vibration amplitude and may be adjustable. A speed of rotation defines the vibration frequency. The respective squeezing drive 10, 12 is designed as a hydraulic drive with a hydraulic cylinder and a control- or regulating valve. In this, the respective effective axis 20 of the hydraulic cylinders lies advantageously in a common plane of symmetry 21 extending perpendicularly to the pivot axes 15.

For transmission of a vibratory motion 22 and a squeezing motion 23 to the first tamping tool 13, the first squeezing drive 13 is coupled directly to the vibration drive 9 and articulatedly connected by a swivel joint 24 to the pivot lever 16 of the first tamping tool 13. In the example of embodiment, an articulated lug of the hydraulic cylinder is mounted on a first eccentric section of the eccentric shaft. In this way, the entire first squeezing drive 13 vibrates when the eccentric shaft rotates. This vibratory motion 22 is superimposed by the squeezing motion 23 as a result of actuation of the first squeezing drive 13.

Figure 3:
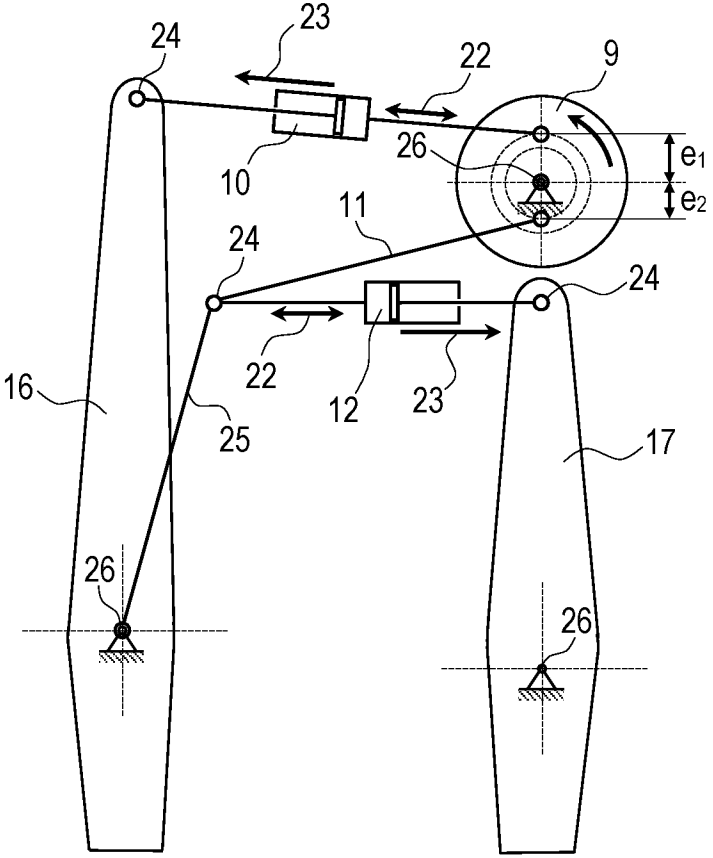
FIG. 3 kinematics according to FIG. 1

At the second tamping tool 14, the transmission of motion takes place in a different manner. Here, the second squeezing drive 12 is coupled to the vibration drive 9 via the separate coupling unit 11 and supported by a link 25 mounted on the tool carrier 7. In the example of embodiment, the connection between the coupling unit 11 and the second squeezing drive 12 is configured as a swivel joint 24. In this, the coupling unit 11 is mounted with an articulated lug on a second eccentric section of the eccentric shaft. The coupling unit 11 functions here as a connecting rod for transforming the circular motion of the eccentric shaft into a pendulum motion of the second squeezing drive 12. FIG. 3 shows the kinematics of this arrangement. For better clarity, the eccentricities $e_1$, $e_2$ are shown enlarged. Fixed bearings 26 shown in the drawings indicate the support points of the components on the tool carrier 7.

Figure 4:
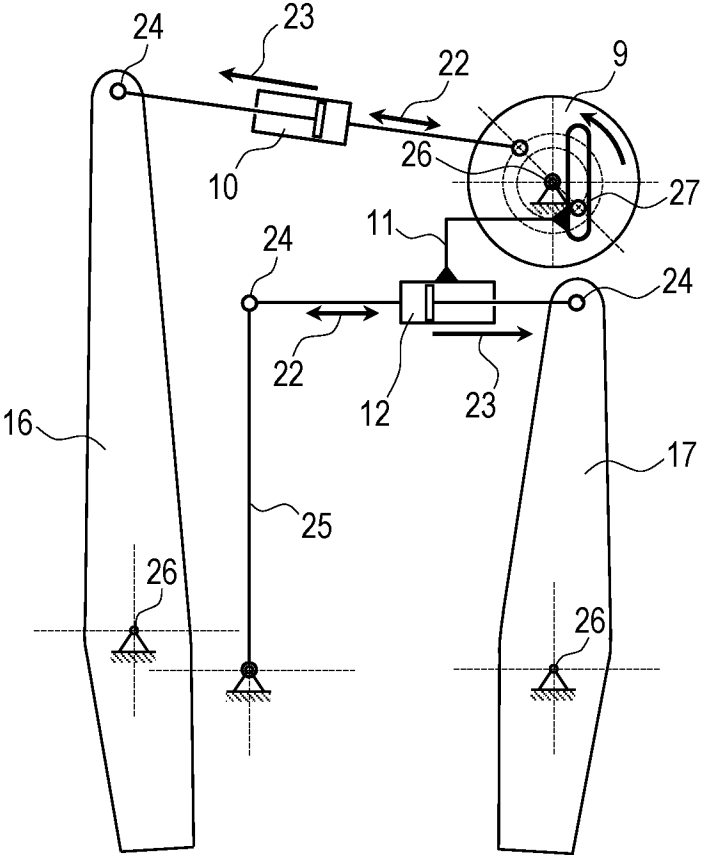
FIG. 4 alternative kinematics

A different embodiment is shown in FIG. 4. Here, the coupling unit 11 is rigidly connected to the second squeezing drive 12 and mounted on the second eccentric section of the eccentric shaft by means of a slot-like guide 27. In this manner, only motions in the direction of the effective axis are transmitted from the eccentric shaft to the coupling unit 11 and thus to the second squeezing drive 12.

The eccentricities $e_1$, $e_2$ of the first eccentric shaft section and of the second eccentric shaft section are preferably arranged offset by about 180° in order to achieve a mass compensation during the generation of vibration. Additionally, it is favourable to design the two eccentricities $e_1$, $e_2$ differently. The respective eccentricity $e_1$, $e_2$ is then optimally matched to the kinematic arrangement of the associated tamping tool 13, 14, so that all tamping tine ends always have the same vibration amplitude in operation.

For symmetrical force transmission to the second pivot lever 17, the coupling unit 11 and the link 23 each have two arms which are arranged symmetrically to the plane of symmetry 21. In this, each coupling arm has an articulated lug. The second eccentric section of the eccentric shaft is of two-part design, wherein the two articulated lugs of the coupling unit 11 are mounted on either side of the articulated lug of the first squeezing drive 10. In this manner, no momentums about a vertical axis are acting on the eccentric shaft during operation.

As a result of the new arrangement of the motion-transmitting elements, a very compact design of the tamping assembly 1 is possible. The squeezing drives 10, 12 are arranged one below the other, so that the overall size of the tamping assembly 1 in the longitudinal direction of the rails is only slightly larger than the length of a squeezing drive 10, 12. In addition, the vibration drive 9 is not arranged symmetrically between the two tamping tools 13, 14, as is the case with conventional tamping assemblies. The present arrangement of the vibration drive 9 above the second tamping tool 14 creates space for a centred arrangement of the vertical adjustment drive 8. As a result of the centred force application during lowering and lifting of the tool carrier 7 thus achieved, longitudinal guides 28 on the assembly frame 2 are conserved since there are no momentums about a transverse axis.

In a tamping assembly 1 for tamping a sleeper 5, usually four tamping units 29 are arranged side-by-side, wherein at either side of a rail 6 a respective tamping unit 29 is employed. The present compact design enables also the arrangement of several structurally identical tamping units 29 one behind the other in an assembly frame 2. In this, each tamping unit 29 is guided separately on longitudinal guides 28 and can be lowered or lifted by means of a separate vertical adjustment drive 8. In this way, several adjacent sleepers 5 can be tamped simultaneously in one working pass.

The invention claimed is:

1. A tamping assembly for tamping sleepers of a track, comprising:

a vertically adjustable tool carrier;

a tamping unit having oppositely positioned tamping tools mounted on said vertically adjustable tool carrier, a plurality of squeezing drives, a vibration drive, wherein the tamping tools are coupled in each case via one of said squeezing drives to said vibration drive, wherein each tamping tool comprises a pivot lever rotatable about a pivot axis and at least one tamping tool mount for accommodating at least one tamping tine, wherein a first squeezing drive of said plurality of squeezing drives is coupled directly to the vibration drive and articulatedly connected to a first pivot lever, that a second squeezing drive of said plurality of squeezing drives is coupled to the vibration drive via a separate coupling unit and articulatedly connected to a link, mounted on the tool carrier, as well as to a second pivot lever wherein the link is mounted for rotation about the pivot axis of the first pivot lever.

2. The tamping assembly according to claim 1, wherein the pivot axes of the two pivot levers are arranged at different heights.

3. The tamping assembly according to claim 1 wherein the vibration drive includes an eccentric shaft, that an articulated lug of the first squeezing drive is mounted on a first eccentric shaft section, and that an articulated lug of the coupling unit is mounted on a second eccentric shaft section.

4. The tamping assembly according to claim 3, wherein the first eccentric shaft section and the second eccentric shaft section have different eccentricities.

5. The tamping assembly according to claim 1, wherein each squeezing drive comprises a hydraulic cylinder having an effective axis, and that all effective axes lie in a common plane of symmetry extending perpendicularly to the pivot axes.

6. The tamping assembly according to claim 5, wherein the coupling unit has two coupling arms which are arranged symmetrically to the plane of symmetry, and/or that the link has two link arms which are arranged symmetrically to the plane of symmetry.

7. The tamping assembly according to claim 1, wherein a connection of the second squeezing drive to the coupling unit is designed as a swivel joint having a rotation axis extending parallel to the pivot axes.

8. The tamping assembly according to claim 7, wherein the connection of the second squeezing drive to the coupling unit and to the link is designed as a common swivel joint.

9. The tamping assembly according to claim 1, wherein several tool carriers are mounted for vertical adjustment in a common assembly frame.

* * * * *